US006582248B2

(12) United States Patent
Bachman

(10) Patent No.: US 6,582,248 B2
(45) Date of Patent: Jun. 24, 2003

(54) DURABLE RJ-45 DATA CONNECTOR ASSEMBLY

(75) Inventor: Werner Bachman, Rankweil (AT)

(73) Assignee: Neutrik AG, Liechtenstein (LI)

( * ) Notice: Subject to any disclaimer, the term of this patent is extended or adjusted under 35 U.S.C. 154(b) by 0 days.

(21) Appl. No.: 10/012,082

(22) Filed: Nov. 29, 2001

(65) Prior Publication Data

US 2003/0100215 A1 May 29, 2003

(51) Int. Cl.[7] ..... H01R 13/58
(52) U.S. Cl. ..... 439/462; 439/461; 439/447
(58) Field of Search ..... 439/459, 462, 439/470, 447, 461, 418, 463, 464

(56) References Cited

U.S. PATENT DOCUMENTS

| | | | | |
|---|---|---|---|---|
| 4,703,989 A | * | 11/1987 | Price et al. | 439/283 |
| 4,944,536 A | * | 7/1990 | Bartholomew | 285/319 |
| 5,564,951 A | * | 10/1996 | Attal et al. | 439/676 |
| 5,567,174 A | * | 10/1996 | Ericson, Jr. et al. | 439/462 |
| 5,803,770 A | * | 9/1998 | Swendson et al. | 439/676 |

* cited by examiner

*Primary Examiner*—P. Austin Bradley
*Assistant Examiner*—Phuongchi Nguyen
(74) *Attorney, Agent, or Firm*—Neal L. Slifkin; Harris Beach LLP.

(57) ABSTRACT

A system for protecting a cable connector, and especially an RJ-45 cable connector, from damage or abuse during use with a chassis receptacle. A cylindrical carrier housing for the connector contains a transverse septum having a shaped opening for receiving and positioning the connector within the housing. A radially-compressible chuck on the cable compresses to grip the cable. A boot on the cable and protrudes from the housing through an overriding bushing threadedly connected to the housing. The boot isolates the cable from flexural stresses. When the bushing is tightened onto the housing, the boot is urged toward the housing, radially compressing the chuck onto the cable. Longitudinal stresses on the cable are therefore isolated from the connector and are transferred instead to the housing. A mating chassis receptacle is receivable of the connector and has an annular groove on an axial face thereof for receiving and rotationally positioning the housing for insertion into the receptacle. A releasable spring catch on the receptacle arrests the housing after electrical contacts between the connector and the receptacle have been established.

9 Claims, 4 Drawing Sheets

DURABLE RJ-45 DATA CONNECTOR ASSEMBLY

TECHNICAL FIELD

The present invention relates to electrical connectors for electronic data cables; more particularly, to RJ-45 data connectors; and most particularly to a durable RJ-45 data connector assembly having positive latching, cable strain relief, positive guiding, and a rugged housing.

BACKGROUND OF THE INVENTION

Cable transmission of electronic data between computational systems is well known. Such cable typically employs a multi-channel end plug or connector, similar in configuration to a rectangular telephone plug. One widely used eight-channel connector is known in the art as an "RJ-45" connector. For example, personal computer network connections frequently employ an RJ-45 connector to the individual computers at the network card interface.

An RJ-45 cable is typically available having an RJ-45 connector attached to each end. In some applications, the standard RJ-45 connector is vulnerable to damage and failure. For example, it is not well suited to repeated insertions into and removal from a chassis receptacle; the contacts are readily bent or misaligned through misinsertion. The plastic locking tab can fatigue and be broken off such that the connector then is not firmly retained in the receptacle. The cable itself is vulnerable to failure from repeated sharp flexing at the point of entry of the cable into the connector. The cable is also vulnerable to being torn from the connector by longitudinal stress. The connector housing is formed of plastic and is easily deformed or destroyed by being accidentally crushed, as by being stepped upon.

What is needed is a protective assembly for a cable connector, particularly an RJ-45 connector, which facilitates insertion into and removal from a chassis receptacle; which positively guides the connector into the receptacle contacts during insertion and positively locks the connector into the receptacle without repeated flexure of the connector's own locking tab; which grips the cable to isolate the electrical connector from longitudinal cable stresses; which protects the cable from sharp flexures near the point of entry of the cable into the connector; and which may be retrofitted to any existing cable connector.

SUMMARY OF THE INVENTION

The invention is directed to an assembly for protecting a cable connector, and especially an RJ-45 cable connector, from damage or abuse during insertion into a mating cable receptacle, operation while in the cable receptacle, and removal from a cable receptacle. A cylindrical carrier housing for the connector is open at both ends and contains a transverse septum having a shaped opening for receiving and positioning the connector within the housing. A radially-compressible chuck disposed coaxially on the cable urges the connector against a stop on the septum and also, when compressed, grips the cable. A generally conical boot is also disposed coaxially on the cable and protrudes distally of the housing through an overriding coaxial bushing which is threadedly connected to the housing. When the bushing is tightened onto the housing, the boot is urged toward the housing, thereby radially compressing the chuck onto the cable. Longitudinal stresses on the cable are therefore isolated from the connector and are transferred instead to the housing. A mating chassis receptacle is receivable of the connector and has an annular recess on an axial face thereof for receiving and positioning the proximal end of the housing. A releasable spring catch on the receptacle arrests the housing after electrical contacts between the connector and the receptacle have been established.

BRIEF DESCRIPTION OF THE DRAWINGS

The foregoing and other objects, features, and advantages of the invention, ,is well as presently preferred embodiments thereof, will become more apparent from a reading of the following description in connection with the accompanying drawings, in which.

DESCRIPTION OF THE PREFERRED EMBODIMENT

Figure 11:
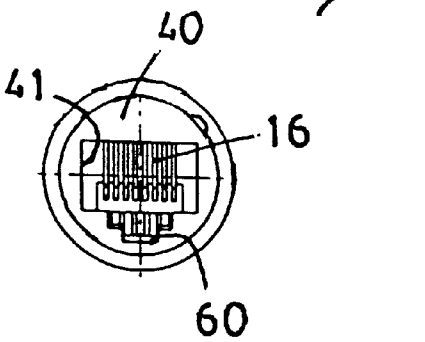
FIG. 11 is an elevational view of the mating face of the assembled connector shown in FIGS. 6, 7, and 10.
Figure 10:
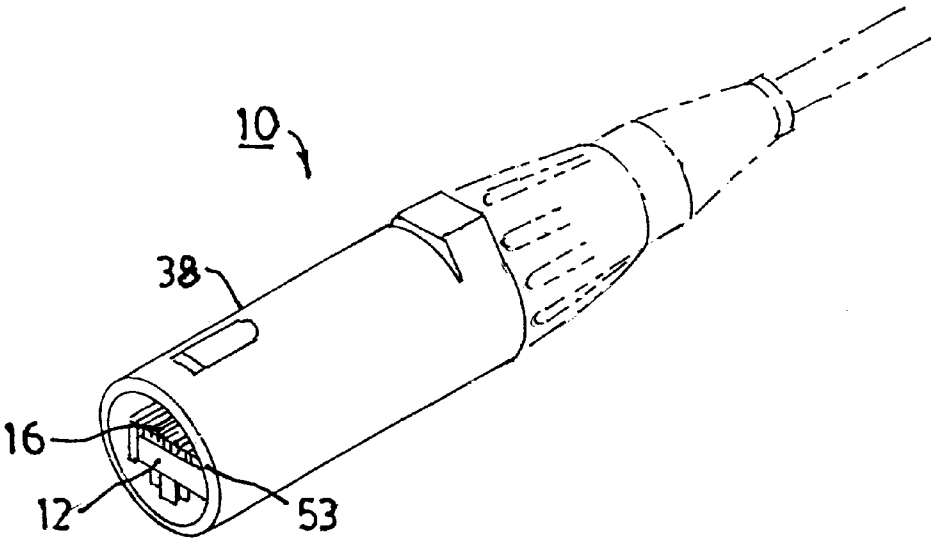
FIG. 10 is an isometric view from the front of an assembled connector in accordance with the invention.

Referring to FIGS. 1 through 6, a durable cable connector assembly 10 (FIGS. 6, 10, 11) in accordance with the invention may be assembled onto an existing standard cable connector 12, for example, an RJ-45 data connector, conventionally disposed on an end of a data cable 14. Connector 12 is shown in two alternate orientations in FIGS. 1 and 2, terminals 16 down in FIG. 1 (not visible) and up in FIG. 2. The connector 12 includes a resilient tab 58 for releaseably locking the connector into place, as is known in the art.

Figure 1:
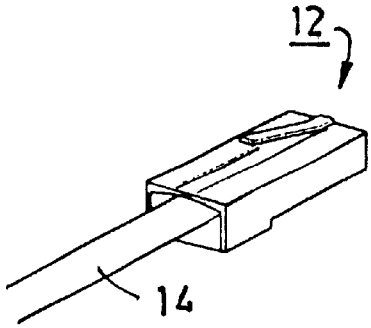
FIG. 1 PRIOR ART
FIGS. 1 and 2 are top and bottom isometric views of a cable connector attached to the end of a data-transmission cable.
Figure 2:
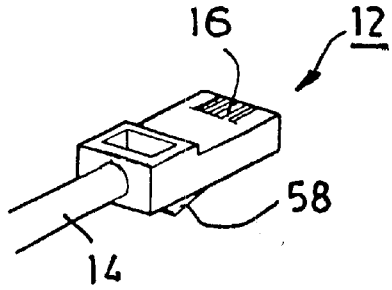
FIG. 2 PRIOR ART
Figure 3:
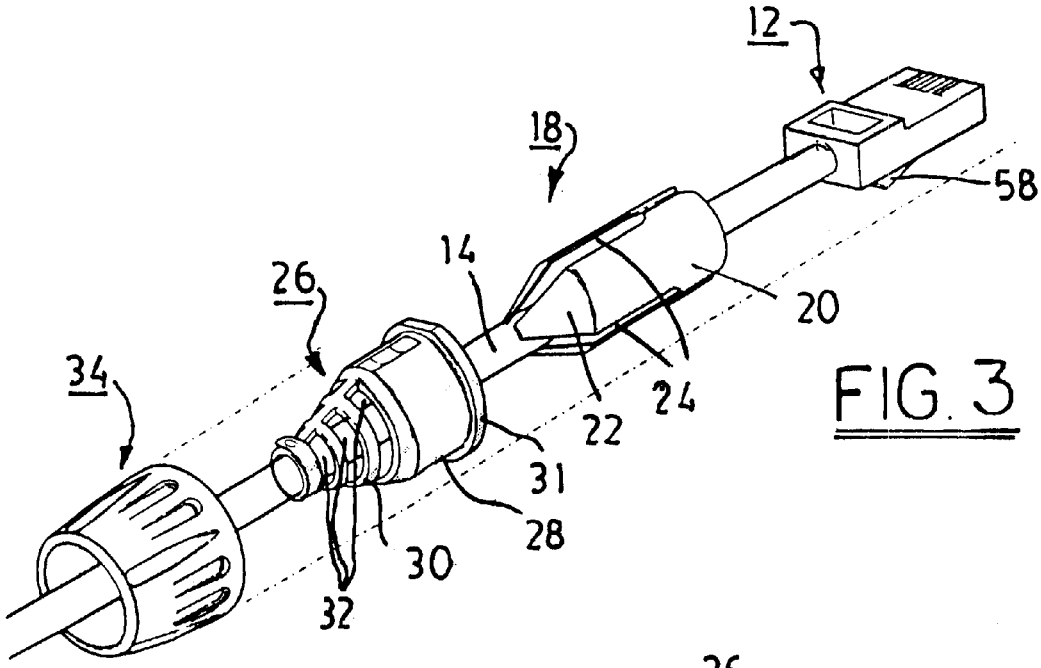
FIG. 3 is an exploded isometric view, showing the placement of a bushing, boot, and chuck on a cable in preparation for assembly in accordance with the invention.
Figure 4:
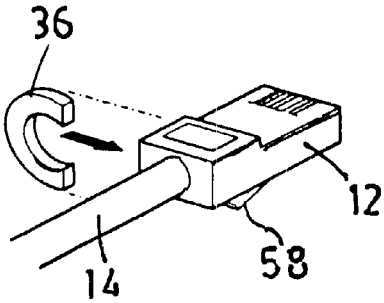
FIG. 4 is an isometric view showing placement of a C-ring stopper on the cable.
Figure 5:
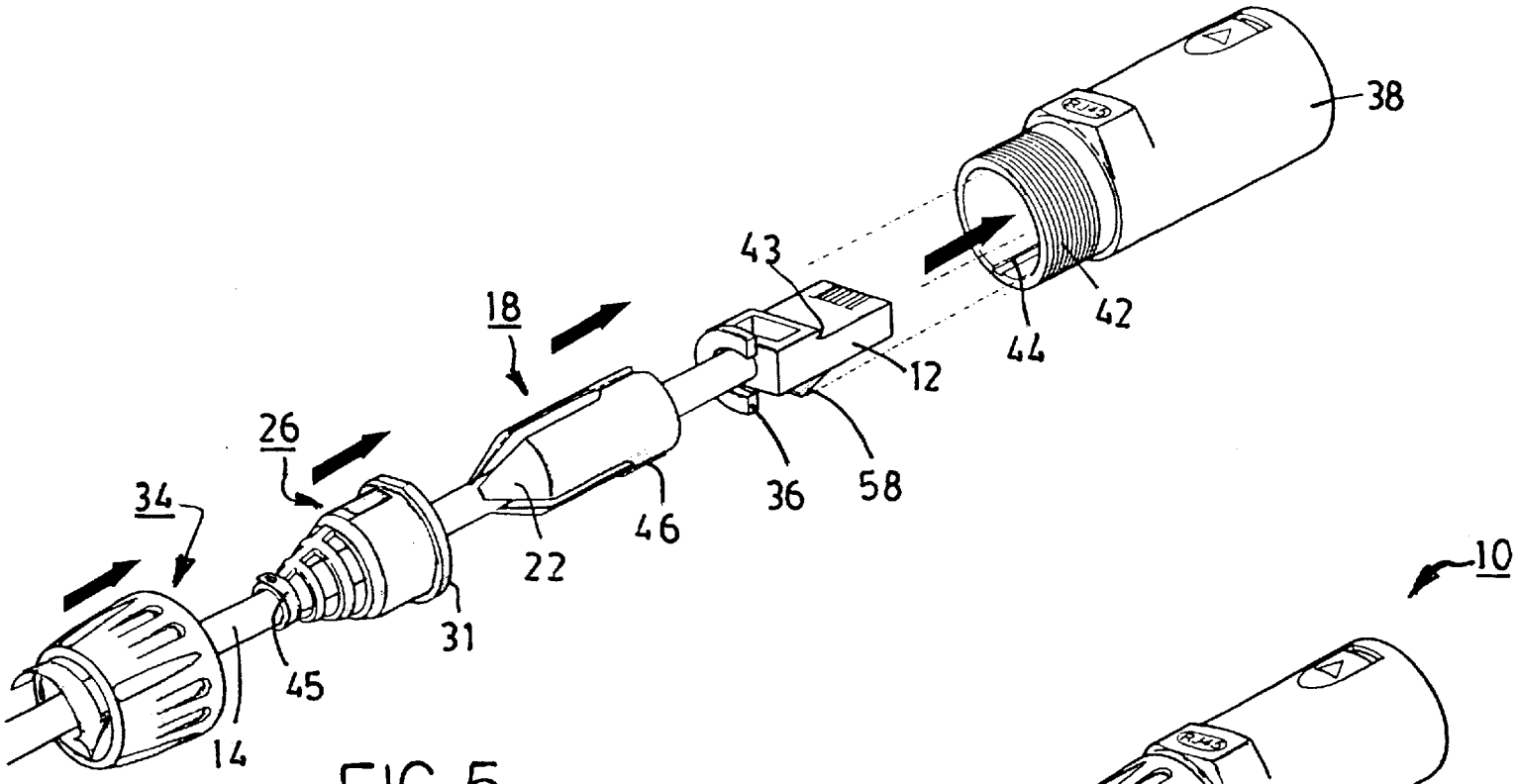
FIG. 5 is an exploded isometric view, showing insertion of the bushing, boot, chuck, and C-ring stopper into a connector housing.

Components and sequence of assembly of durable cable connector 10 are shown in FIGS. 3 through 5. Chuck 18 is formed of a resilient plastic as generally cylindrical over a first portion 20 proximal to connector 12 and generally conical of a second portion 22 distal from connector 12. The cylinder and cone are segmented axially by longitudinal slots 24 over a portion of the overall length of chuck 18 such that the cone portions may be radially compressed as described below for the chuck to firmly engage cable 14. Additionally, one of slots 24 extends the full length of chuck 18 so that the chuck may be opened and snapped onto the cable as shown in FIG. 3.

A boot 26 also has a generally cylindrical portion 28 and a generally conical portion 30. The inner surface of portion 28 is axially tapered to engage conical portion 22 of chuck 18 when the chuck enters boot 26 as described below. Like chuck 18, boot 26 is also axially split to permit its being snapped onto cable 14. Preferably, conical portion 30 is formed having spaced-apart annular slots 32. Boot 26 has a radial flange 31 extending around its proximal end.

Bushing 34 is generally cylindrical and has an inner diameter greater than the outer diameter of boot portion 28 but less than the diameter of flange 31 such that boot 26 may pass through bushing 34 but is retained therein by flange 31. Bushing 34 may be disposed onto cable 14 by passing connector 12 through the bushing before installing the boot and chuck onto the cable. Bushing 34 is provided with female threads (not visible in FIG. 3) on an inner surface thereof proximal to connector 12.

C-ring 36 may be engaged onto cable 14 adjacent connector 12, as shown in FIG. 4, as a thrust element for chuck 18 during assembly.

Housing 38 is generally cylindrical, preferably formed of die-cast metal, and has a transverse septum 40 (FIGS. 7,8,11) having an aperture 41 (FIG. 11) identical to the cross-sectional profile of connector 12. The aperture 41 includes a recess 60 for receiving the resilient tab 58, and holding the resilient tab 58 in a depressed position. Septum 40 is disposed within housing 38 at a longitudinal location selected to position connector 12 within the housing. Housing 38 is provided with a male threaded portion 42 for engaging bushing 34 during assembly. Preferably, housing 38 is provided with a longitudinal groove 44 on an inner surface thereof for engaging a mating longitudinal rib 46 on chuck 18 to prevent relative rotation therebetween during assembly.

Figure 6:
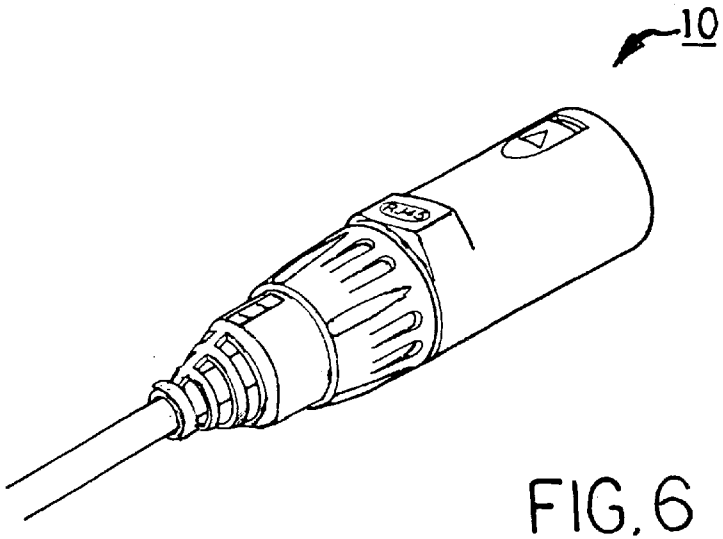
FIG. 6 is an isometric view from the rear of an assembled connector in accordance with the invention.

Durable cable connector assembly 10 is assembled as shown in FIG. 5 to form completed assembly 10, as shown in FIG. 6. Connector 12 and C-ring 36 are inserted into housing 38 through aperture 41 until arrested by step 43 in connector 12. Chuck 18 is inserted into housing 38 until the chuck engages C-ring 36, rib 46 being aligned and slidably mating with groove 44. Boot 26 is engaged with conical portion 22 of chuck 18. Bushing 34 is slid over boot 26 until flange 31 is engaged within the bushing. Boot 26 protrudes from the bushing, as shown in FIG. 6. Bushing 34 is then screwed onto threads 42 on housing 38. Boot 26 is urged against chuck 18 and thereby causes conical portion 22 to be compressed radially onto cable 14. Connector 12 is urged against septum 40 and is thereby firmly and correctly positioned within housing 38. After bushing 34 is fully tightened onto housing 38, thus firmly attaching chuck 18 onto cable 14, a seal strap 45 on boot 26 may be snapped around cable 14 to secure the boot thereto. Annular slots 32 in boot 26 permit flexure of the boot in response to flexure imposed upon cable 14. Thus the cable is protected by boot 26 from damage due to sharp flexures, and by chuck 18 from damage due to longitudinal stress. Further, cable connector 12 is protected from crushing damage or abuse by rugged die-cast housing 38.

Figure 7:
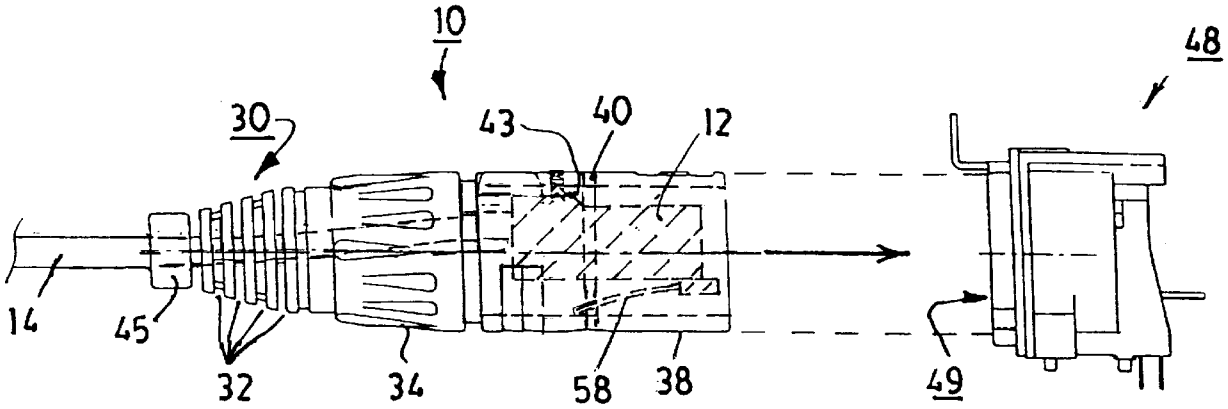
FIG. 7 is an exploded elevational view of an assembled connector and a chassis receptacle in accordance with the invention.
Figure 8:
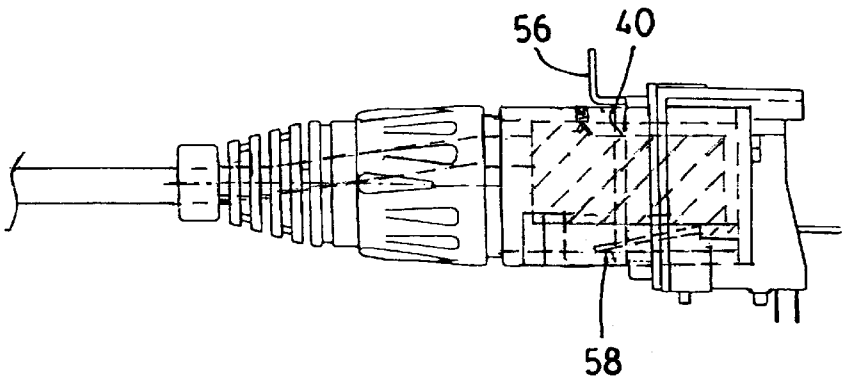
FIG. 8 is an assembled elevational view of the connector and chassis receptacle shown in FIG. 7.
Figure 9:
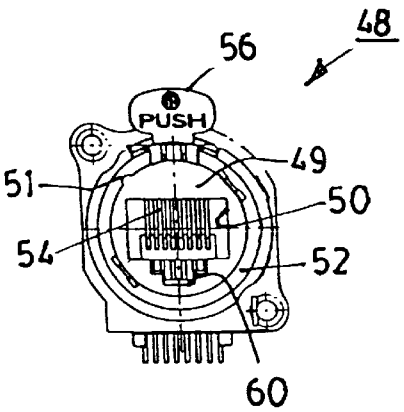
FIG. 9 is an elevational view of the mating face of the chassis receptacle shown in FIGS. 7 and 8.

Assembly 10 is receivable in a chassis receptacle 48 (FIGS. 7 and 9) having a face surface 49 and a female aperture 50 therein in the cross-sectional shape of connector 12. An annular recess 52 surrounds surface 49 for receiving housing 38 as shown in FIGS. 7 and 8. A longitudinal rib 51 on receptacle 48 mates with a longitudinal groove 53 in housing 38 to positively orient cable connector 12 rotationally with respect to aperture 50 for assured insertion. The longitudinal depth of recess 52 is selected such that when housing 38 bottoms out in recess 52, the terminals 16 of connector 12 are correctly positioned in contact with terminals 54 of receptacle 48. Connector assembly 10 is removably retained in receptacle 48 by a snap catch 56.

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiments may be modified in light of the above teachings. The embodiments described are chosen to provide an illustration of principles of the invention and its practical application to enable thereby one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

What is claimed is:

1. A data connector assembly for installation onto a multi-channel cable end plug having terminals, the assembly being formed to position the plug terminals for direct electrical and mechanical contact with mating terminals in a receptacle and for locking the connector assembly into the receptacle, comprising:

a) a housing having positioning means for positioning said multi-channel end plug at a predetermined location within said housing and having thread means formed on a surface thereof, said positioning means including a transverse septum within said housing, said plug being positioned such that said plug terminals can make direct contact with said mating terminals in said receptacle through an open end of said housing;

b) a radially-compressible chuck for urging said multi-channel end plug to said predetermined location and for gripping said cable;

c) a tapered boot for radially compressing said chuck; and d) a threaded bushing for arresting said tapered boot and for mating to said threads on said housing in a threaded joint for compressing said bushing, boot, chuck, housing, and multi-channel end plug together to form said assembly.

2. An assembly in accordance with claim 1 wherein said housing is formed of die-cast metal.

3. An assembly in accordance with claim 1 wherein said boot includes a slotted conical portion protrudable through said bushing to form a flexure relief for said cable.

4. An assembly in accordance with claim 1 wherein said housing is provided with a first longitudinal groove and said chuck is provided with a mating first longitudinal rib for preventing relative rotation between said housing and said chuck.

5. An assembly in accordance with claim 1 wherein said multi-channel end plug is an RJ-45 connector.

6. An assembly in accordance with claim 1 further comprising a recess in said housing for receiving a resilient tab of said cable connector and for retaining said resilient tab in a depressed position within said recess.

7. An assembly in accordance with claim 1 further comprising a chassis receptacle for matably receiving said connector assembly to complete at least one electrical connection therebetween.

8. An assembly in accordance with claim 7 wherein said housing is provided with a second longitudinal groove and said receptacle is provided with a mating second longitudinal rib for properly orienting said multi-channel end plug with respect to said receptacle during insertion of said assembly into said receptacle.

9. An assembly in accordance with claim 7 further comprising a snap catch for removably attaching said connector assembly to said chassis receptacle.

* * * * *